United States Patent [19]

King

[11] 4,162,222

[45] Jul. 24, 1979

[54] GREASE COMPOSITIONS

[75] Inventor: James P. King, Upper Gwynedd Township, Montgomery County, Pa.

[73] Assignee: The United States of America as represented by the Secretary of the Air Force, Washington, D.C.

[21] Appl. No.: 933,935

[22] Filed: Aug. 15, 1978

[51] Int. Cl.[2] ..... C10M 1/48; C10M 3/42; C10M 1/44; C10M 3/38

[52] U.S. Cl. ..... 252/32.7 E; 252/32.5; 252/49.6

[58] Field of Search ..... 252/32.5, 32.7 E, 49.6

[56] References Cited

U.S. PATENT DOCUMENTS 3,522,178 7/1970 Peschko et al. ..... 252/32.5

*Primary Examiner*—Delbert E. Gantz
*Assistant Examiner*—Irving Vaughn
*Attorney, Agent, or Firm*—Joseph E. Rusz; Cedric H. Kuhn

[57] ABSTRACT

Grease compositions comprising a silicone fluid and a thickening amount of a poly(metal phosphinate) containing at least one XP(R) (H)X group, where X is oxygen or sulfur and R is alkyl or aryl.

6 Claims, No Drawings

GREASE COMPOSITIONS

RIGHTS OF THE GOVERNMENT

The invention described herein may be manufactured or used by or for the Government of the United States for all governmental purposes without the payment of any royalty.

FIELD OF THE INVENTION

This invention relates to grease compositions having superior performance properties. In one aspect, it relates to poly(metal phosphinates) that are particularly useful for thickening silicone fluids.

BACKGROUND OF THE INVENTION

In the past, inorganic polymers have been added to various fluids to obtain grease compositions. For example, as disclosed in U.S. Pat. No. 3,332,873, greases are made from phosphate esters by the addition of certain doubly bridged inorganic polymers coordinated with two unidentate ligands. According to U.S. Pat. No. 3,331,774, a diester liquid is converted to a grease by the addition of similar inorganic polymers consisting of doubly bridged chromium atoms coordinated with a hydroxyl group and a water molecule. U.S. Pat. No. 3,331,775 discloses that silicone fluids are converted to greases by adding a relatively low molecular weight doubly bridged chromium phosphinate polymer. And in U.S. Pat. No. 3,522,178, it is revealed that grease compositions can be obtained by using triply bridged chromium atoms where the bridging groups are the anions of phosphinic acids.

In general, silicones show a weak response to the usual lubricity additives and oiliness agents. Also, silicones do not respond well to antiwear and extreme pressure agents, and the few additives that do show some response have an inadequate thermal stability. To obtain silicone greases with good properties, an additive is required that can function as a thickener and provide other properties as well without detracting from such characteristics as thermal stability, consistency, thickener-fluid compatability, drop point, and fluid separation at elevated temperatures.

It is an object of this invention, therefore, to provide a thickening agent for silicone fluid that fulfills the abovementioned requirements.

Another object of the invention is to provide a grease composition based on a silicone fluid that possesses good antiwear and extreme pressure properties.

Other objects and advantages of the invention will become apparent to those skilled in the art upon consideration of the accompanying disclosure.

SUMMARY OF THE INVENTION

The present invention resides in a grease composition based on a silicone fluid thickened with a poly(metal phosphinate) containing at least one XP(R) (H)X group, where X is oxygen or sulfur, and R is an alkyl or aryl radical. The poly(metal phosphinates) function as thickeners for silicone fluids to provide a grease having good antiwear and extreme pressure properties. The effectiveness of the present poly(metal phosphinates) is attributed to the presence of the hydrogen atom attached to the phosphorus atom in the XP(R) (H)X group. Silicone fluids thickened with other poly(metal phosphinates), which do not contain such a group, do not possess the outstanding properties of the instant grease compositions.

The poly(metal phosphinates) used as thickeners in the grease composition of this invention can be represented by the following formulas:

$$M[XP(R_a')(R_b'')X]_c[XP(R)(H)X]_d \text{ or} \quad (1)$$

$$M_4'O_4(OH)_x[XP(R)(H)X]_{8-x}, \quad (2)$$

wherein M is trivalent chromium or iron, M' is tetravalent titatnium, zirconium or hafnium, X is oxygen or sulfur, R is alkyl or aryl, R' is alkyl, R'' is aryl, a and b are each zero, 1 or 2 and the sum of a and b is 2, c is zero, 1 or 2 and d is equal to 3-c, and x ranges from zero to 7.9. The R, R' and R'' radicals generally contain about 1 to 12 carbon atoms. Examples of such radicals include methyl, ethyl, t-butyl, hexyl, octyl, decyl, dodecyl, phenyl, tolyl, xylyl, naphthyl, and the like. From the foregoing, it will be understood that so long as the poly(metal phosphinate) contains a XP(R)(H)X group other phosphinate groups may be present that do not have a hydrogen atom attached to the phosphorus atom.

The poly(metal phosphinate) according to formula (1) above is synthesized by initially preparing a polymeric chromium (or iron bis(phosphinate) in accordance with the procedure described by H. D. Gillman et al in Inorganic Syntheses, XVI, 89–92 (1976). As disclosed in this publication, a solution of a phosphinic acid and potassium carbonate in water-tetrahydrofuran is added with stirring to a solution of a soluble simple chromium salt, such as chromium chloride, in water-tetrahydrofuran. The resulting mixture is brought to a boil and the tetrahydrofuran is allowed to evaporate. After most of the tetrahydrofuran has evaporated, additional water is added. Boiling is continued until a precipitate is formed that can be readily ground with a spatula. The precipitate is then separated, thoroughly washed with water, and then allowed to dry. The water-containing polymer obtained is then heated under a vacuum to constant weight, thereby converting it to a hydroxobis(-phosphinate) polymer. The bisphosphinate polymer is then reacted in a low boiling solvent, such as chloroform, with a hydrophosphinic acid having the formula R(H)P(X)XH, where R and X are as indicated hereinabove, resulting in the formation of a gel in the solvent. After standing for 15 to 60 minutes, the gel forms a viscous solution of the thickening agent of this invention. A hydrophosphinic acid may be used in preparing the bisphosphinate in which case a polymer according to formula (1) is obtained in which c is equal to zero and d is equal to 3. Alternatively, a phosphinic acid having the formula $R_a'R_b''P(X)XH$ where R', R'', a, b and X are as indicated above, may be utilized alone or in admixture with a hydrophosphinic acid in preparing the bisphosphinate in which case a polymer according to formula (1) is obtained in which c is 1 or 2 and d is 2 or 1.

When preparing a grease composition using a poly[-chromium (or iron) phosphinate] of formula (1) as the thickener, the viscous solution mentioned in the preceding paragraph is added to the silicone fluid. The resulting mixture is then stirred while heating to a temperature of about 120° C. whereby the solvent is evaporated and a grease is formed. The grease is then cured by heating at a temperature ranging from about 150 to 250° C. for a period of about 1 to 2 hours. In general, the amount of thickener utilized is that which is sufficient to thicken the silicone fluid to a grease-like consistency. The amount utilized usually ranges from about 5 to 20 weight percent, preferably about 5 to 15 weight percent, based upon the weight of the grease composition.

The poly(metal phosphinates) acording to formula (2) above are synthesized directly in the silicone fluid to be thickened to a grease composition. Initially, zirconium oxychloride ($ZrOCL_2.8H_2O$), or the corresponding titanium or hafnium compound, is dissolved in distilled water and then hydrolyzed with an ammonium hydroxide solution. After washing with distilled water, the wet hydrolyzed solid [$ZrO(OH)_2.XH_2O$] is then reacted at a temperature between about 80° and 110° C. with a hydrophosphinic acid having the formula R(H)P(X)XH, where R and X are as indicated above, dispersed in the silicone fluid to be thickened. The reaction mixture is continuously stirred for a period of about 60 minutes while being maintained at a temperature of about 110° C. During this heating period, any water separating from the reaction mixture is decanted off. The poly(metal phosphinate) that forms thickens the silicone fluid to a grease-like consistency. The grease is cured by heating at a temperature ranging from about 150° to 250° C. for a period of about 1 to 2 hours.

The composition of the thickener can be varied by controlling the mole ratio of zirconium oxychloride to hydrophosphinic acid. It is often preferred to utilize equimolar amounts in which case the poly(metal phosphinate) has the formula $M_4'O_4(OH)_4[OP(R)(H)O]_4$, where M' and R are as defined above. In general, the amount of thickener that is formed in the silicone fluid is that which is sufficient to thicken the fluid to a grease-like consistency. The amount usually ranges from about 20 to 35 percent by weight, preferably about 25 to 30 weight percent, based upon the weight of the grease composition.

The silicone fluids used as a base oil in forming the grease composition of this invention are well known, commercially available products. The fluid is preferably a liquid polyorganosiloxane having a high phenyl content and diphenylmethylsilyl end groups. The polyorganosiloxanes can be produced by hydrolyzing and polymerizing a mixture of diphenylmethylchlorosilane, dimethyldichlorosilane and diphenyldichlorosilane in a ratio of 1:1:1 according to procedures known to those skilled in the art. While the polyorganosiloxanes are generally a mixture of polymers, a general formula representing the polymer mixture by an idea molecule is as follows:

$$CH_3(C_6H_5)_2SiO[(CH_3)_2SiO]_x](C_6H_5)_2Si\text{-}O]_ySi(C_6H_5)_2CH_3,$$

where x and y can be from 1 to 10 and higher. Other silicone fluids, such as poly(methylphenylsiloxane) (Dow Corning 550 lubricant) can also be used.

A more complete understanding of the invention can be obtained by referring to the following illustrative examples which are not intended, however, to be unduly limitative of the invention.

EXAMPLE I

Preparation of $Cr[OP(Mc)(Ph)O]_2[OP(Ph)(H)O]$-High Phenyl Content Polysiloxane Grease A mixture of 7.58 g (0.02 mole) of $Cr[OP(Mc)(Ph)O]_2OH$ polymer (prepared by the procedure described in Inorganic Syntheses, XVI, 89 (1976)) and 2.85 g (0.02 mole) of Ph(H)P(O)OH was suspended in 60 ml of $CHCl_3$, resulting in the formation of a gel, which after 20 minutes became a viscous solution. The solution was added to 163 g of high phenyl content polysiloxane. The resulting mixture was agitated with a Z-blade stirrer and heated slowly to 120° C. in an oil bath. As the solvent evaporated during heating, the solution became viscous and subsequently formed a grease. The oil bath was raised to 170° C. and held at this temperature for 30 minutes. The grease was transferred to a beaker and cured at 200° C. for 90 minutes followed by milling several times on a three-roll mill. The extreme pressure and other physical properties of the grease are set forth in Table I hereinafter.

EXAMPLE II

Preparation of $Cr[OP(Mc)(Ph)O]_3$-High Phenyl Content Polysiloxane Grease

In a control run, a grease was prepared using $Cr[OP(Mc)(Ph)O]_3$ polymer as the thickener for high phenyl content polysiloxane. The polymer was prepared by the procedure described in Inorganic Syntheses, XVI, 89 (1976), using methylphenylphosphinic acid. The same conditions as described in Example I were followed in preparing the grease except that it was cured at 250° C. for 2 hours before milling. Extreme pressure and other properties of the grease are listed hereinafter in Table I.

TABLE I

| | Base[1] Fluid | $Cr[OP(Me)(Ph)O]_2[OP(Ph)(H)O]$ Thickened Grease Example I | $Cr[OP(Me)(Ph)O]_3$ Thickened Grease Example II |
|---|---|---|---|
| Wt Percent of Fluid | 100 | 94 | 94 |
| Wt Percent Thickener | | 6 | 6 |
| Penetration (ASTM D 1403) | | | |
| Unworked (Conv. to D 217) | | 346 | 347 |
| Worked (Conv. to D 217) | | 331 | 347 |
| Drop Point (ASTM D 566), °F. | | >500 | >500 |
| Oil Separation (FTMS 791-321) | | | |
| Wt % after 30 hrs at 400° F. | | 6.4 | 16.0 |
| Oxidation Stability (ASTM D 942) | | | |
| Psig $O_2$pressure drop | | | |

TABLE I-continued

| | Base[1] Fluid | $Cr[OP(Me)(Ph)O]_2[OP(Ph)(H)O]$ Thickened Grease Example I | $Cr[OP(Me)(Ph)O]_3$ Thickened Grease Example II |
|---|---|---|---|
| in 600 hrs, 210° F. | | 0 | 0 |
| Extreme Pressure Properties (ASTM D 2596) | | | |
| Weld point, kg (AISI-C-52100 steel) | 126 | 250 | 160 |

[1]High phenyl content polysiloxane (MCO 66-21); 100° F. viscosity, 240 cs; pour point, +25° F.

EXAMPLE III

Preparation of $Zr_4O_4(OH)_4[OP(Ph)(H)O]_4$-High Phenyl Content Polysiloxane Grease Zirconium oxychloride ($ZrOCl_2.8H_2O$) in the amount of 64.6 g (0.2 mole) was dissolved in distilled water (300 ml) and then hydrolyzed with 400 g 1N $NH_4OH$ solution. The wet hydrolyzed solid [$ZrO(OH_2.xH_2O$] after being washed several times with distilled water was reacted with 28.2 g (0.2 mole) Ph(H)(P(O)OH dispersed in 124 g high phenyl content polysiloxane between 80 and 110° C. The reaction mixture was continuously stirred for 60 minutes in a 110° C. oil bath. During this heating period, a small amount of water separated from the reaction product and was decanted off. The thickened product was heated at 150° C. to a constant weight and then milled several times on a three-roll mill. Evaluation data on the grease are shown hereinafter in Table II.

EXAMPLE IV

Preparation of $Zr_4O_4(OH)_4[OP(Mc)(Ph)O]_4$-High Phenyl Content Polysiloxane Grease In a control run, $Zr_4O_4(OH)_4[OP(Mc)(Ph)O]_4$-high phenyl content polysiloxane grease was prepared. Except for using methylphenylphosphinic acid instead of phenylhydrophosphinic acid, the same procedure as described in Example III was followed. Evaluation data are shown hereinafter in Table II.

TABLE II

| | Base[1] Fluid | $Zr_4O_4(OH)_4[OP(Ph)(H)O]_4$ Thickened Grease Example III | $Zr_4O_4(OH)_4[OP(Me)(Ph)O]_4$ Thickened Grease Example IV |
|---|---|---|---|
| Weight % of Fluid | 100 | 70 | 70 |
| Weight % of Thickener | | 30 | 30 |
| Penetration (ASTM D 1403) | | | |
| Unworked (Conv. to D 217) | | 256 | 275 |
| Worked (Conv. to D 217) | | 279 | 282 |
| Drop Point (ASTM D 566), °F. | | >464 | >464 |
| Oil Separation | | | |
| Wt % after 30 hrs at 400° F. | | 3.0 | 2.8 |
| Oxidation Stability (ASTM D 942) | | | |
| Psig $O_2$ pressure drop after 600 hrs at 212° F. | | 0 | 0 |
| Extreme Pressure Properties (ASTM D 2596) | | | |
| Weld Point, kg | 126 | 250 | 282 |
| Wear Prevention Characteristics (ASTM D 2266) | | | |
| 40 kg load, 1200 rpm, 167° F. and 1 hr | | | |
| Scar diameter, mm | 3.75 | 1.91 | 2.44 |

[1]High phenyl content polysiloxane (MCO 66-21); 100° F. viscosity, 240 cs; pour point, +25° F.

The data in Table I show the effect on certain properties of $Cr[OP(Mc)(Ph)O]_3$-polysiloxane grease after replacing one of the OP(Mc)(Ph)O groups with a OP(Ph)(H)O group. Thus, the data demonstrate that the grease containing a poly(chromium phosphinate) having a OP(Ph)(H)O group possessed superior extreme pressure and oil separation properties. As shown by the data in Table II, the greases thickened with a poly(zirconium phosphinate) containing OP(Ph)(H)O groups provided a significant improvement on wear scar diameter as compared to a grease thickened with a poly(zirconium phosphinate) which did not contain such a group. It is thus seen that the poly(metal phosphinates) containing at least one XP(R)(H)X group, where X is oxygen or sulfur and R is alkyl or aryl, are effective grease thickeners for silicone fluids.

As will be evident to those skilled in the art, modifications of the present invention can be made in view of the foregoing disclosure without departing from the spirit and scope of the invention.

I claim:

1. A grease composition comprising a silicone fluid and a thickening amount of a poly(metal phosphinate) selected from the group of polymers having the following formulas:

$$M[XP(R_a')(R_b'')X]_c]XP(R)(H)X]_d \text{ and} \quad (1)$$

$$M_4'O_4(OH)_x[XP(R)(H)X]_{8-x}, \quad (2)$$

wherein M is trivalent chromium or iron, M' is tetravalent titanium, zirconium or hafnium, X is oxygen or sulfur, R is alkyl or aryl, R' is alkyl, R'' is aryl, a and b are each zero, 1 to 2 and the sum of a and b is 2, c is zero, 1 or 2, d is equal to 3-c, and x ranges from zero to 7.9.

2. The grease composition according to claim 1 in which the poly(metal phosphinate) has the following formula:

$$M[XP(R_a')(R_b'')X]_c[XP(R)(H)X]_d.$$

3. The grease composition according to claim 2 in which the poly(metal phosphinate) has the following formula:

$$Cr[OP(Me)(Ph)O]_2[OH(Ph)(H)O].$$

4. The grease composition according to claim 2 in which the poly(metal phosphinate) has the following formula:

$$Cr[OP(Ph)(H)O]_3.$$

5. The grease composition according to claim 1 in which the poly(metal phosphinate) has the following formula:

$$M_4'O_4(OH)_x[XP(R)(H)X]_{8-x}.$$

6. The grease composition according to claim 5 in which the poly(metal phosphinate has the following formula:

$$Zr_4O_4[OP(Ph)(H)O]_4.$$

* * * * *

UNITED STATES PATENT AND TRADEMARK OFFICE

CERTIFICATE OF CORRECTION

PATENT NO. : 4,162,222

DATED : July 24, 1979

INVENTOR(S) : James P. King

It is certified that error appears in the above-identified patent and that said Letters Patent are hereby corrected as shown below:

Column 4, line 16, in the formula, "Mc" should read -- Me --.
Column 4, line 18, in the formula, "Mc" should read -- Me --.
Column 4, line 37, in the formula, "Mc" should read -- Me --.
Column 4, line 40, in the formula, "Mc" should read -- Me --.
Column 5, line 64, in the formula, "Mc" should read -- Me --.
Column 5, line 66, in the formula, "Mc" should read -- Me --.
Column 6, line 49, in the formula, "Mc" should read -- Me --.
Column 6, line 50, in the formula, "Mc" should read -- Me --.
Column 8, line 5, in the formula, "OH" should read -- OP --.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*